United States Patent [19]

Oates

[11] Patent Number: 4,518,162

[45] Date of Patent: May 21, 1985

[54] WEIGHTED EXERCISE BAR

[76] Inventor: William J. Oates, 101 E. C Ave., Easley, S.C. 29640

[21] Appl. No.: 432,016

[22] Filed: Sep. 30, 1982

[51] Int. Cl.[3] ..... A63B 23/00

[52] U.S. Cl. ..... 272/93; 272/117; 272/128; 403/349

[58] Field of Search ..... 272/93, 117, 123, 125, 272/127, 128, 126; 403/349; 273/68

[56] References Cited

U.S. PATENT DOCUMENTS

| | | | |
|---|---|---|---|
| 405,128 | 6/1889 | Stockburger | 272/123 |
| 1,145,127 | 7/1915 | Dunnebacke | 273/68 |
| 1,714,391 | 5/1929 | McWhirter | 272/93 |
| 2,601,088 | 6/1952 | Burgess | 403/349 X |
| 3,820,781 | 6/1974 | Kane | 272/93 |
| 3,874,660 | 4/1975 | Brethen | 272/128 X |
| 3,957,266 | 5/1976 | Rice | 272/125 |

FOREIGN PATENT DOCUMENTS

| | | | |
|---|---|---|---|
| 456791 | 3/1928 | Fed. Rep. of Germany | 272/93 |

*Primary Examiner*—Richard J. Johnson
*Attorney, Agent, or Firm*—Cort Flint

[57] ABSTRACT

A weighted exercise bar A is illustrated as including a pair of sections (10) and (12) joined together at a moment resisting joint (B) by means of a cam lock slot and pin (32), (34). Weights (C) provide uniform extensions at the ends of the bar.

2 Claims, 4 Drawing Figures

WEIGHTED EXERCISE BAR

BACKGROUND OF THE INVENTION

The invention relates to an exercise device for exercising of the human torso by twisting about the waist. Prior twisting exercise devices for twisting the torso have included straight bars which extend across the shoulders and behind the neck during exercise. Even smaller sticks such as broomstick handles have been utilized in performing the typical twist exercise about the waist.

Typically, the forearms are draped over the ends of the bar or stick since it is of relatively light weight to hold the bar firmly during twisting motions such that the body and stick move as a unit in twisting the upper torso of the body about the waist. Little influence, if any, is felt by the presence of the stick which serves mainly to position the torso and upper appendages during the exercise.

A different approach is disclosed in U.S. Pat. No. 3,820,781 wherein a waist exercise bar is disclosed having a yoke section at about a midpoint such that the oppositely extending ends of the bar lie substantially forward of the main body of the person's shoulder when the yoke section is draped around the back of the neck. Weighted sections may be added to the bar intermediate the yoke and end sections of the bar. This location of weights and forward bar arrangement displaces the torque forces forward of the body which results in a different exercise affect as well as diminished torque distribution affects during the exercise.

A straight bar properly held by the exerciser by gripping the bar underneath, and not by draping the forearms over the bar, is desirable in certain exercises, such as for posture development, particularly where the exercise affects can be increased simply and in an expedient manner. A straight bar also provides for additional exercise positions such as overhead and front thigh exercise positions.

Accordingly, an important object of the present invention is to provide an improved exercising bar for exercising the body torso and waist.

Yet another important object of the present invention is to provide a weighted exercise bar having weights concentrated at the outermost ends thereof to increase accelerating torques during twisting.

Still another important object of the present invention is to provide a generally straight weighted exercise bar which separates into two sections for storage and transportation.

Yet another important object of the present invention is to provide a weighted exercise bar for twisting exercises having a pair of sections which are joined together by means of a quick-release cam lock mechanism.

Still another important object of the present invention is to provide a weighted exercise bar which includes a pair of sections joined together by a quick release connection which is reinforced to bending moments produced at the joint thereof.

SUMMARY OF THE INVENTION

The above objectives are accomplished according to the present invention by providing an elongated weighted exercise bar which includes a pair of sections joined together at a moment resisting joint approximately midway of the bar by means of a quick-release connection such that the bar may be broken down easily. A weighted extension is carried on the end of each section which has the same general cross-sectional shape as the section. Uniform weighted extensions of the bar element are thus provided which minimizes problems in the peripheral clearance of the bar. The elongated bar is of sufficient length to permit the weighted extensions to extend past the hands of the exerciser when gripping the bar in an exercise position with the arms spread apart and the bar supported on the shoulders for twist exercising.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 2:
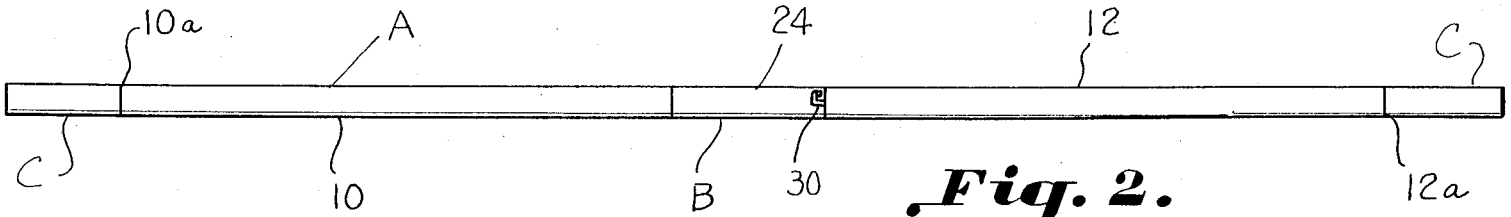
FIG. 2 is an elevation illustrating a weighted exercise bar constructed according to the present invention.
Figure 3:
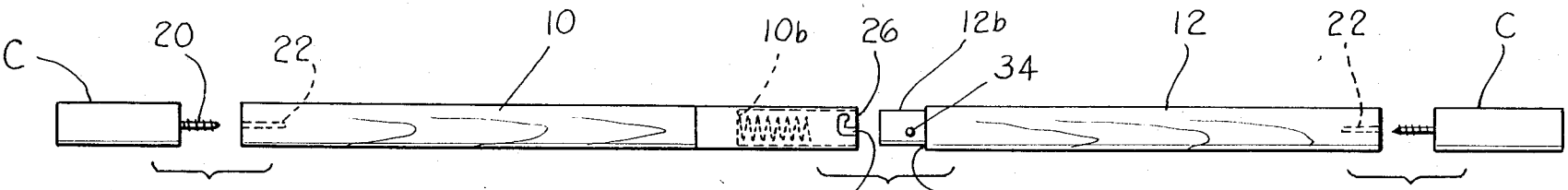
FIG. 3 is an elevation illustrating a weighted sectional exercise bar constructed according to the present invention with the sections and weighted components broken apart.
Figure 4:
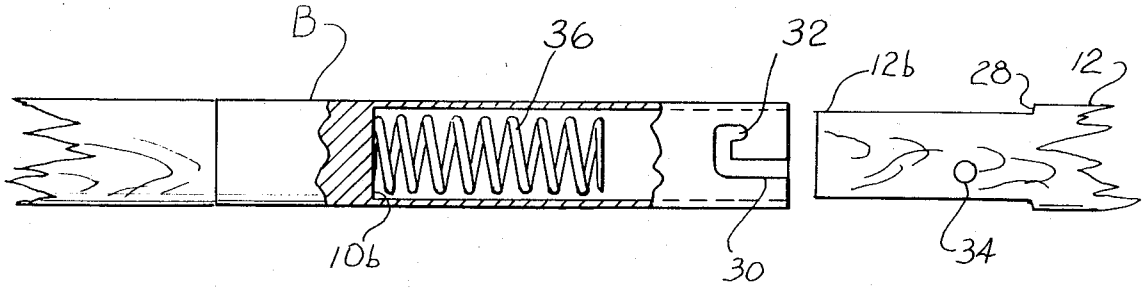
FIG. 4 is a partial cut-away view illustrating a moment resisting joint and quick-release connection for two sections of a weighted exercise bar constructed according to the present invention.

Referring now to the drawings, an elongated exercise bar device A is illustrated which includes two elongated sections 10 and 12 forming a bar of a predetermined length as defined by the two remote ends 10*a* and 12*a* of the sections when joined together. The sections are joined together by a moment resisting joint B approximately midway of the bar. The elongated bar sections 10 and 12 are preferably made from wood and are circular in cross-section having a diameter of approximately 1 $\frac{3}{8}$ of an inch. The bar is generally straight and uniform at its cross-section along its entire length.

As illustrated, a weighted member C is illustrated at each end of the sections 10 and 12. The weighted members have a cross-section corresponding to that of the cross-sections 10 and 12 such that they represent a weighted uniform extension of the ends of the bar as would come closely within the normal range of the bar during its peripheral movement. The exerciser does not have to remain overly conscious of the presence of the weights at the periphery of the bar during exercising. The uniform extensions avoid problems as would be caused in the clearing of surrounding obstacles by attached weights extending radially from the bar. Weighted members C are preferably formed of steel and weigh approximately two and one-half pounds each. Means for connecting the weighted members to the wood bar sections may include any suitable means such as a male threaded member 20 formed as part of the weight which is received in a female threaded member 22 formed in the elongated sections.

In practice, it has been found that weighted members C approximately six inches in length, and wood elongated bar, comprising sections 10 and 12, approximately sixty-four inches to sixty-six inches in length, greatly multiply the exercise affect over that of a homogeneous wood stick. A ratio of approximately 1:5 to 1:55 of the steel to wood length is preferred. By concentrating the weights at the outermost ends of the bar, increases of over four-hundred percent in acceleration torques has been achieved over prior homogeneous wood stick bars. It has been found that for longer bar lengths the bar becomes unwieldy and awkward to use and that for shorter bar lengths, accelerating torque is not effectively distributed.

Figure 1:
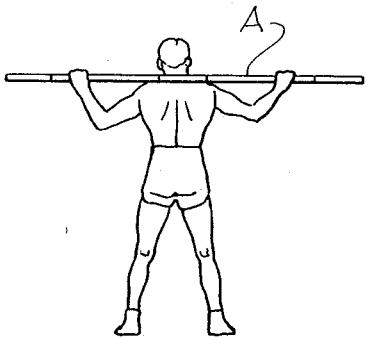
FIG. 1 is a front view illustrating the exercise position of an exerciser utilizing an exercise bar constructed according to the present invention.

This length is also sufficient so that the weighted extensions extend past the hands of an exerciser when gripping the bar in a exercise position with the arms spread and the bar supported on the shoulders and gripped underneath for twist exercising such as shown in FIG. 1. Thus, the result of providing a bar in the range of five feet to five feet six provides the expedient of both good accelerating torque ratios and proper handling and gripping by the exerciser for effective body and waist exercise.

A quick-release connection is provided for joining the sections 10 and 12 at joint B. A sleeve 24 is included in joint B which is affixed to the adjoining end **10*b* of section 10 and provides a means for resisting the bending moment between ends 10*b* and 12*b* of the exercise bar at the joint when under the motion and torques exerted by the weighted members on the ends. The sleeve 24 includes a metallic sleeve having an opening which receives the adjoining end 12*b* of the section 12 which is reduced. The reduced end includes a shoulder 28 which rests against and fits against the front of the sleeve. The quick-release connection for connecting the adjoining ends together includes a cam slot 30 formed in the sleeve having a cam lock portion 32 in which a lock pin 34 carried by the end 12*b* fits for securing the ends together. A biasing spring 36 is carried within the hollow portions of sleeve 24 and urges the adjoining ends apart such that the lock pin 34 is urged within the cam lock 32** for a lock tight connection. The sections may be quickly broken down for transportation and storage.

Thus, it can be seen that an advantageous construction for an exercise bar can be had according to the present invention wherein the weights are concentrated at the ends of the bar to produce increased accelerating torques during exercise. Gripping of the bar in a proper exercise position with the hands supported underneath the bar transmits increased inertial moment forces into the arms and upper chest muscles multiplying the exercise affect to the chest and upper body as well as the waist.

While a preferred embodiment of the invention has been described using specific terms, such description is for illustrative purposes only, and it is to be understood that changes and variations may be made without departing from the spirit or scope of the following claims.

What is claimed is:

1. An exercise bar device for use in twisting exercises about the exerciser's waist comprising:

an elongated bar including a plurality of elongated sections joined by a releaseable joint between adjoining ends of adjacent sections forming a bar of a predetermined length defined by the outermost remote ends of said sections joined together;

said elongated bar being generally straight and uniform in its cross-section along its entire length;

a generally solid weighted member carried at each of said ends extending longitudinally therefrom within the periphery of said bar;

each said weight member having a cross-section corresponding to the cross-section of said bar defining weighted uniform extensions of about two and one-half pounds thereof at said ends;

said elongated bar having a sufficient length so that said weighted extensions extend past the hands of an exerciser when gripping the bar in an exercise position with the arms spread and the bar supported on the shoulders for twist exercising;

a quick release connection joining said sections together at said joint enabling said device to be broken down into sections for storage and transportation; and said length of said elongated bar having a ratio to the total length of said weight members of approximately five to one so that an exercise bar is provided having effective accelerating torque for exercise yet may be grasped by outreached hands without reaching the weights and whose total length is not unweildly facilitating use in an interior room space and the like.

2. An exercise bar device for use in twisting exercises about the exerciser's waist comprising:

an elongated bar including two elongated sections having a joint approximately midway of said bar forming a bar of a predetermined length defined by two remote ends of said sections joined together;

said elongated bar being generally straight and uniform in its cross-section along its entire length;

a weighted member of about two and one-half pounds carried at each of said ends extending longitudinally therefrom within the periphery of said bar;

said weighted member having a cross-section corresponding to the cross-section of said bar defining weighted uniform extensions thereof at said ends;

said elongated bar having a sufficient length so that said weighted extensions extend past the hands of an exerciser when gripping the bar in an exercise position with the arms spread and the bar supported on the shoulders for twist exercising;

a quick release connection joining said sections together at said joint enabling said device to be broken down into sections for storage and transportation;

a tubular hollow sleeve included in said quick release connection fixed to a first adjoining end of a first of said sections, said sleeve being open at an opposing end for receiving a second adjoining end of a second of said sections, said sleeve effectively resisting flexing of said first and second sections relative to each other during twisting exercises;

said quick release connection including a cam slot formed in said sleeve affixed to said first adjoining end, said cam slot including a circumferential slot and longitudinally formed lock slot;

a lock pin carried by said second adjoining end of said second section;

a joint space formed between said first adjoining end of said first bar section and said second adjoining end of said second bar section when received in said tubular sleeve affixed to said first section; and biasing means carried in said joint space between said first and second adjoining ends of said first and second sections urging said lock pin into a locking position in said lock slot, said biasing means urging said second adjoining end in a direction opposite to said first adjoining end within said tubular sleeve; and a generally rigid joint which is generally free of play provided for said adjoining ends of said first and second sections by said quick release connection at said joint so that said sections do not flex relative to each other during twisting exercises yet are quickly releasable for breakdown.

* * * * *